US006425485B1

(12) United States Patent
Mankosa et al.

(10) Patent No.: US 6,425,485 B1
(45) Date of Patent: Jul. 30, 2002

(54) AIR-ASSISTED DENSITY SEPARATOR DEVICE AND METHOD

(75) Inventors: Michael J. Mankosa, Erie, PA (US); Gerald H. Luttrell, Blacksburg, VA (US)

(73) Assignee: Eriez Magnetics, Erie, PA (US)

( * ) Notice: Subject to any disclaimer, the term of this patent is extended or adjusted under 35 U.S.C. 154(b) by 0 days.

(21) Appl. No.: 09/276,212

(22) Filed: Mar. 25, 1999

Related U.S. Application Data

(60) Provisional application No. 60/079,388, filed on Mar. 26, 1998.

(51) Int. Cl.[7] ..... B03D 1/02; B03D 1/24; B03B 5/66; B03B 7/00

(52) U.S. Cl. ..... 209/164; 209/166; 209/170; 209/158; 209/159; 209/454; 209/474

(58) Field of Search ..... 209/164, 168, 209/170, 158, 159, 160, 161, 454, 166, 474

(56) References Cited

U.S. PATENT DOCUMENTS

| | | | | |
|---|---|---|---|---|
| 2,176,107 | A | * 10/1939 | Smith | |
| 2,315,536 | A | * 4/1943 | McNeill | |
| 2,533,074 | A | * 12/1950 | Weinig | |
| 2,758,714 | A | 8/1956 | Hollingsworth | 209/168 |
| 2,783,884 | A | * 3/1957 | Schaub | |
| 2,965,557 | A | * 12/1960 | Price | |
| 3,246,749 | A | * 4/1966 | Moser | |
| 3,298,519 | A | * 1/1967 | Hollingsworth | |
| 3,730,341 | A | * 5/1973 | Mames et al. | |
| 4,396,396 | A | 8/1983 | Mainwaring | |
| 4,822,493 | A | 4/1989 | Barbery et al. | 210/703 |
| 4,851,036 | A | * 7/1989 | Anthes | |
| 5,307,937 | A | 5/1994 | Hutwelker | 209/164 |
| 5,392,924 | A | * 2/1995 | Hume | |
| 5,456,362 | A | 10/1995 | Laskowski et al. | 209/164 |

FOREIGN PATENT DOCUMENTS

| | | |
|---|---|---|
| CA | 525 085 | * 5/1956 |
| WO | 89/10202 | * 11/1989 |

* cited by examiner

*Primary Examiner*—Thomas M. Lithgow
(74) *Attorney, Agent, or Firm*—Wayne Lovercheck; Richard K. Thomson

(57) ABSTRACT

A process is described for separating particles based on differences in mass after the selective attachment of air bubbles to reduce the density of one or more of the components of the feed. A novel feature of this process is aeration of a hindered-bed of solids in a fluidized-bed separator to create particle/bubble agglomerates that can be separated based on the principal of gravity. This approach offers an improvement in process efficiency that cannot be achieved by other processes. Air and water are mixed in a shear device before the aerated fluidized water is introduced to the separation chamber.

20 Claims, 4 Drawing Sheets

AIR-ASSISTED DENSITY SEPARATOR DEVICE AND METHOD

REFERENCE TO PRIOR APPLICATION

This application claims the benefit of U.S. Provisional Application Ser. No. 60/079,388, filed Mar. 26, 1998.

FIELD OF THE INVENTION

The present invention relates to the use of a separator to partition a particulate assemblage into various constituents based on a difference in particle mass and more particularly to partition a particulate assemblage into various constituents based on a difference in particle mass after the specific gravity of one or more of the components in the assemblage has been decreased by the selective attachment of air bubbles.

BACKGROUND OF THE INVENTION

Gravity concentration devices are used extensively throughout the minerals industry to concentrate high-density particles from a mixture of high- and low-density material. Although many devices have been developed over the years, a technique gaining in popularity is hindered/fluidized-bed separators. These separators, traditionally used for classification, work reasonably well for mineral concentration if the particle size range and density difference are within acceptable limits.

A great deal of research has been devoted to the study of fluidized-beds and their use in gas/solid contacting and in liquid/solid applications. Studies describing the latter have typically focused on the classification aspects of fluidized-bed separators and less so on mineral concentration. Recent work has shown that fluidized-bed separators can be used to effectively separate mineral assemblages that have components with different densities. For instance, coal and the ash forming components (rock), silica and iron ore, and silica from various heavy minerals such as zircon and ilmenite. Results from these studies indicate that efficient concentration can be achieved if the particle size ration (top size to bottom size) is less than 3 or 4 to 1 and in a range from 200 mesh to several millimeters. Unfortunately, this is seldom the case and, as a result, the separation efficiency is poor. To correct this shortcoming, the valuable component (i.e., coal, iron ore, ilmenite and zircon) frequently must be reprocessed to achieve the desired quality.

A hindered-bed separator is a vessel in which water is evenly introduced across the base of the separator and rises upward. The separator typically has an aspect ratio of two or more and is equipped with a means of discharging solids through the bottom of the unit. Rising water and solids flow over the top of the separator and are collected in a launder. Solids are typically introduced in the upper portion of the vessel and begin to settle at a rate defined by the particle size and density. The coarse, higher density particles settle against the rising flow of water and build a bed of teetering solids. This bed of high-density solids has an apparent density much higher than the teetering fluid (water). Since particle settling velocity is driven by the density difference between the solid and liquid phase, the settling velocity of the particles is reduced by the increase in apparent density of the teetering bed. As a result, the low-density component of the feed resists penetrating the bed and remains in the upper portion of the separator where it is transported to the overflow launder by the rising teeter water.

Coarse, low-density particles, however, tend to gather at the interface between the high and low density particles because the teeter water velocity is not sufficient to transport this material to the overflow launder. These particles continue to gather at the bed interface and eventually migrate into the teeter bed, thus reporting with the high-density product. This inherent inefficiency can be partially corrected by increasing the teeter water velocity to convey the coarse, low-density solids to the overflow. Unfortunately, this approach will also cause the fine, high-density solids to be misplaced to the overflow launder resulting in a loss of efficiency. It can be seen, therefore, that a conventional hinder-bed separator has inherent inefficiencies when treating a mineral assemblage that has a Wide particle size distribution and/or a narrow density distribution.

Applicant is aware of the following U.S. Pat. No. 2,758,714 to Hollingsworth; U.S. Pat. No. 4,396,396 to Mainwaring; U.S. Pat. No. 4,822,493 to Barbery; U.S. Pat. No. 5,307,937 to Hutwelker and U.S. Pat. No. 5,456,362 to Laskowski.

SUMMARY OF THE INVENTION

From the discussion presented above it is apparent that modifications should be incorporated into new devices to correct the inefficiencies associated with conventional hindered-bed separators. Typically, the particle size and density distribution of the feed cannot be modified. Therefore, a different approach must be considered. The most obvious means is to further enhance the density difference between the low- and high-density particles in the feed. Similar approaches have been evaluated such as introducing a second lower density liquid that has an affinity for a particular species of particles. A subsequent liquid phase separation is used to concentrate the solids. The use of this oil agglomeration technique has been successfully demonstrated for the separation of coal and ash forming impurities. Unfortunately, this technique suffers from high operating costs and low process capacities.

A distinctive feature of the present invention is aeration of a hindered-bed of solids to modify the effective density of one or more of the species. Aeration is achieved by introducing fine air bubbles with the teeter water supply. The bubbles rise with the upward current, impinge upon the particles and selectively attach to the surface of a particular species. Attachment depends upon the surface characteristics of the particle. For instance, coal is naturally hydrophobic and will spontaneously attach to an air bubble. Applications such as iron ore (with a silica contaminant) require chemical activation of the silica to promote bubble/particle attachment. The method for chemical activation is well known and is routinely used for flotation of fine particles (less than 0.2–0.3 mm).

The concept of bubble-particle attachment in a rising current separator (flotation column) has been previously demonstrated. Unfortunately, the approach uses an open-column reactor operating in the free, not hindered, settling regime. As a result, this configuration does not have the advantages associated with a hindered-bed separator. The distinctive advantage of the present invention is the synergy offered by the combination of a hindered-bed separator and a rising current, open-column flotation cell. The approach combines the pre-concentration of a hindered-bed with the further enhancement of bubble-particle attachment to modify the density of one of the feed components. As a result, separation of coarse, low-density material is greatly enhanced through the addition and attachment of air bubbles. Furthermore, since any particulate species can be chemically rendered hydrophobic, applications are not limited to materials having different densities. In fact, in some instances, the high specific gravity mineral can be enhanced through air addition and will report to the overflow as the light species. The efficiency of the new separator surpasses that which can be achieved by either individual technique.

To recognize the advantages of the invention the fundamental difference between free and hindered-settling conditions must be examined. Separators are generally recognized as falling into one of two categories: free settling or hindered settling. Under free settling conditions individual particles do not affect the settling behavior of adjacent particles and, as such, the pulp has the Theological characteristic of the fluid. Furthermore, the settling velocity is determined by particle size and density as dictated by Stokes' law. Under such conditions, less selective concentration of minerals is achieved.

Hindered settling is fundamentally different. At high solids concentrations, adjacent particles collide with each other influencing the settling characteristics. The settling path is greatly obstructed reducing particle velocity. Additionally, the high solids concentration increases the apparent viscosity and specific gravity of the pulp, thus further reducing particle settling. As a result, the acceleration of particles becomes more important than the terminal velocity. This collision phenomenon is the most important aspect of hindered settling and provides a greater degree of mineral concentration than can be achieved in a free-settling environment.

In addition to the synergy of the combined process, the bubble-particle attachment aspect is also greatly enhanced as a result of the hindered bed. In mineral flotation, it is well known that the recovery of a particular species is predominantly controlled by two parameters: reaction rate and retention time.

An increase in either parameter provides a corresponding increase in recovery. A distinct advantage of this invention is an increase in both reaction rate and retention time beyond that which can be obtained by existing devices.

The reaction rate for a process is indicative of the speed at which the separation will proceed. The rate of separation in a hindered bed is most strongly influenced by the specific gravity difference between particulates. Modifying the particle density through bubble attachment decreases the apparent particle density thus increasing the rate at which material is extracted from the system.

Another advantage of the invention is the increase in the probability of collision between a bubble and particle. It is well known in mineral flotation that the reaction rate is controlled by several probabilities: collision, attachment and detachment. The probability of attachment and detachment are controlled by the process surface chemistry and cell hydrodynamics, respectively. Collision probability, however, is directly proportional to the concentration of particles in the cell. In an open (free settling) system, the collision probability is quite low due to the low particle concentration. A hindered bed provides the highest possible particle concentration while still maintaining the material in a fluid environment; thus maximizing the bubble/particle contact frequency. As a result, the reaction rate is several orders of magnitude higher than that demonstrated by existing systems.

The retention time is a direct measure of the length of time which material is present in the separator. The longer the retention time, the higher the probability the material will be influenced by the reaction. For example, a particle in a flotation cell may not initially encounter a bubble. However, the likelihood of this encounter increases with the time spent in the cell. In the flotation process, particles settle vertically through the cell either with the fluid flow (co-current) or opposite to it (counter-current). A counter-current arrangement has obvious advantages since the settling velocity is reduced by the upward flow of liquid resulting in a higher retention time. Hindered settling, as previously explained, provides an environment in which the particles never achieve their terminal free-fall velocity. As a result, the effective particle velocity through the cell is greatly reduced providing a significant increase in retention time as compared to a free-settling system.

Based on the above description, it is obvious that the separation is not limited to materials with vastly different specific gravities since the density can be modified through the addition of air bubbles.

It is an object of the present invention to provide a separator, which uses air to create or increase the difference between the effective or apparent specific gravities of the materials to be separated.

It is another object of the present invention to provide an air-assisted density separator device that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

Figure 4:
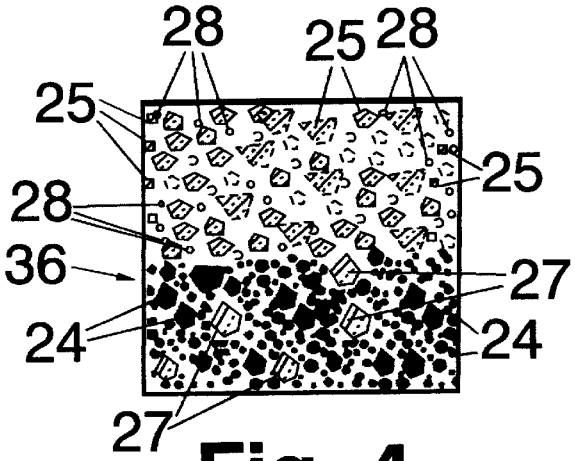
FIG. 4 is an enlarged view of a section of the bubbles and high and low density particles collected about the teeter bed interface in the upper separation chamber.
Figure 7A:
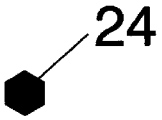
Figure 5:
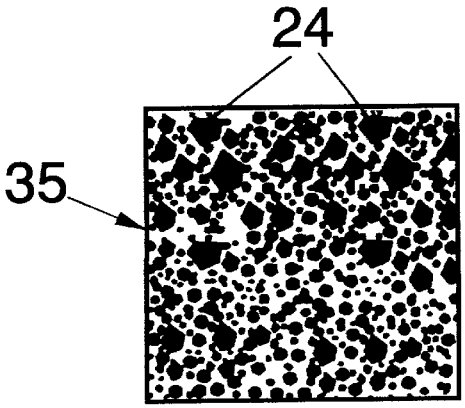
FIG. 5 is an enlarged view of a section of the high density particles collected in the dewatering cone.

FIG. 7*a* is a key of the high density particles shown in FIGS. 4 and 5.

Figure 6:
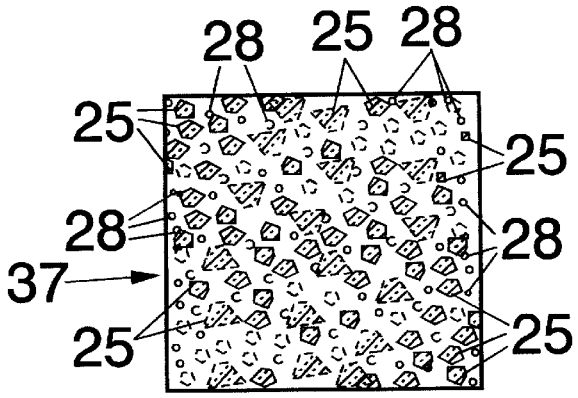
FIG. 6 is an enlarged view of a section of the bubbles and low density particles collected in the upper separation chamber adjacent the collection launder.
Figure 7B:
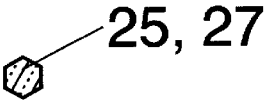

FIG. 7*b* is a key of the low density particles shown in FIGS. 4 and 6.

Figure 7C:
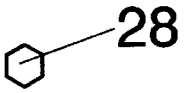

FIG. 7*c* is a key of the air bubbles shown in FIGS. 4 and 6.

DESCRIPTION OF THE PREFERRED EMBODIMENT(S)

Figure 1:
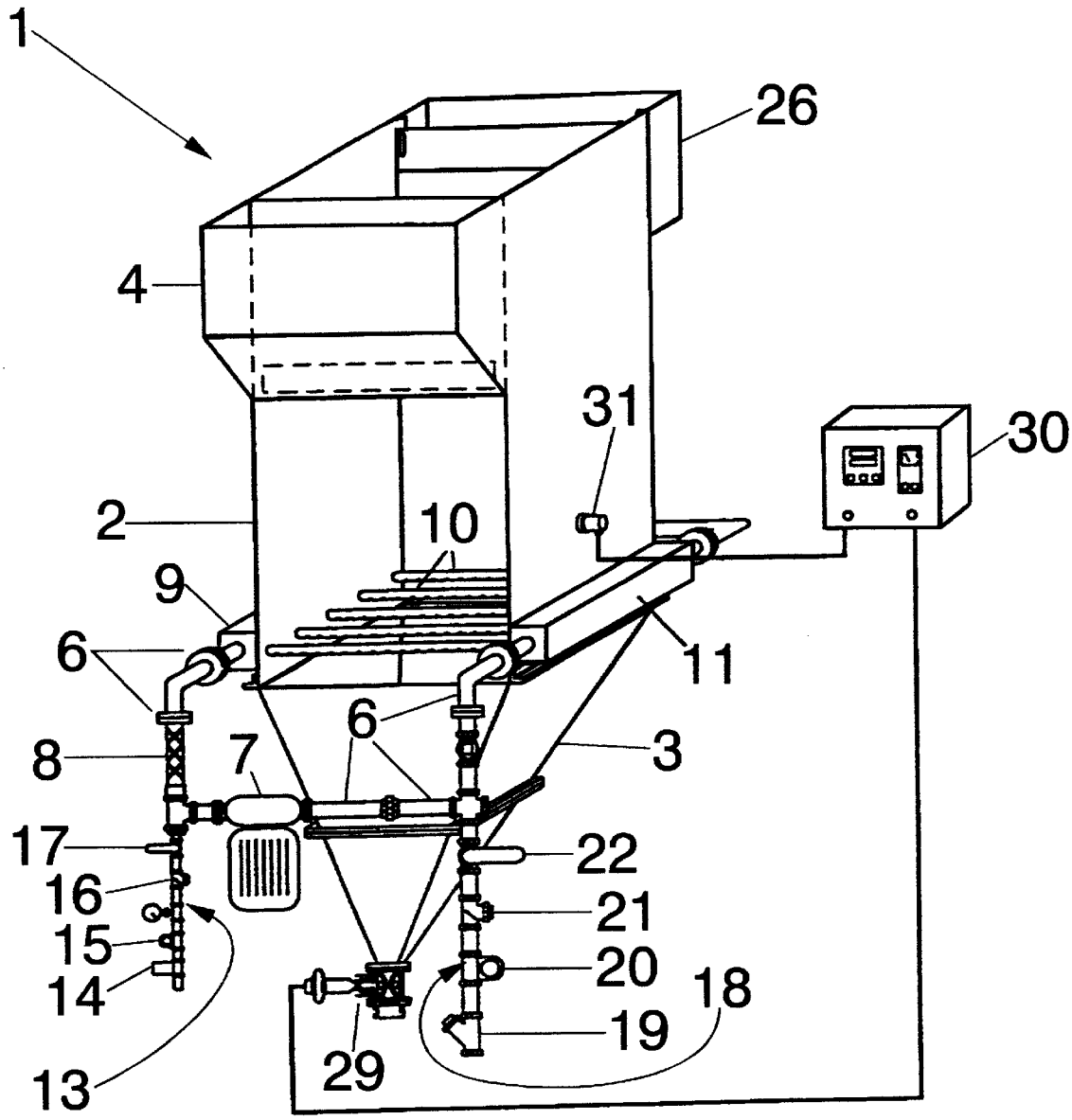
FIG. 1 is a perspective view of the air-assisted density separator according to the invention.

Now with more particular reference to the drawings, FIG. 1 shows a separator consisting of main housing 1, which consists of upper separation chamber 2 and lower dewatering cone 3. Main housing 1 is an enclosed chamber which contains the particulate slurry to be separated. Feed inlet chamber 4 receives the feed material and disperses it throughout the cross section of upper separation chamber 2. Dispersed solids enter upper separation chamber 2 and establish a teeter bed due to the upward flow of water 5. The established teeter bed is aerated to reduce the effective density of a specific portion of the feed.

Figure 2:
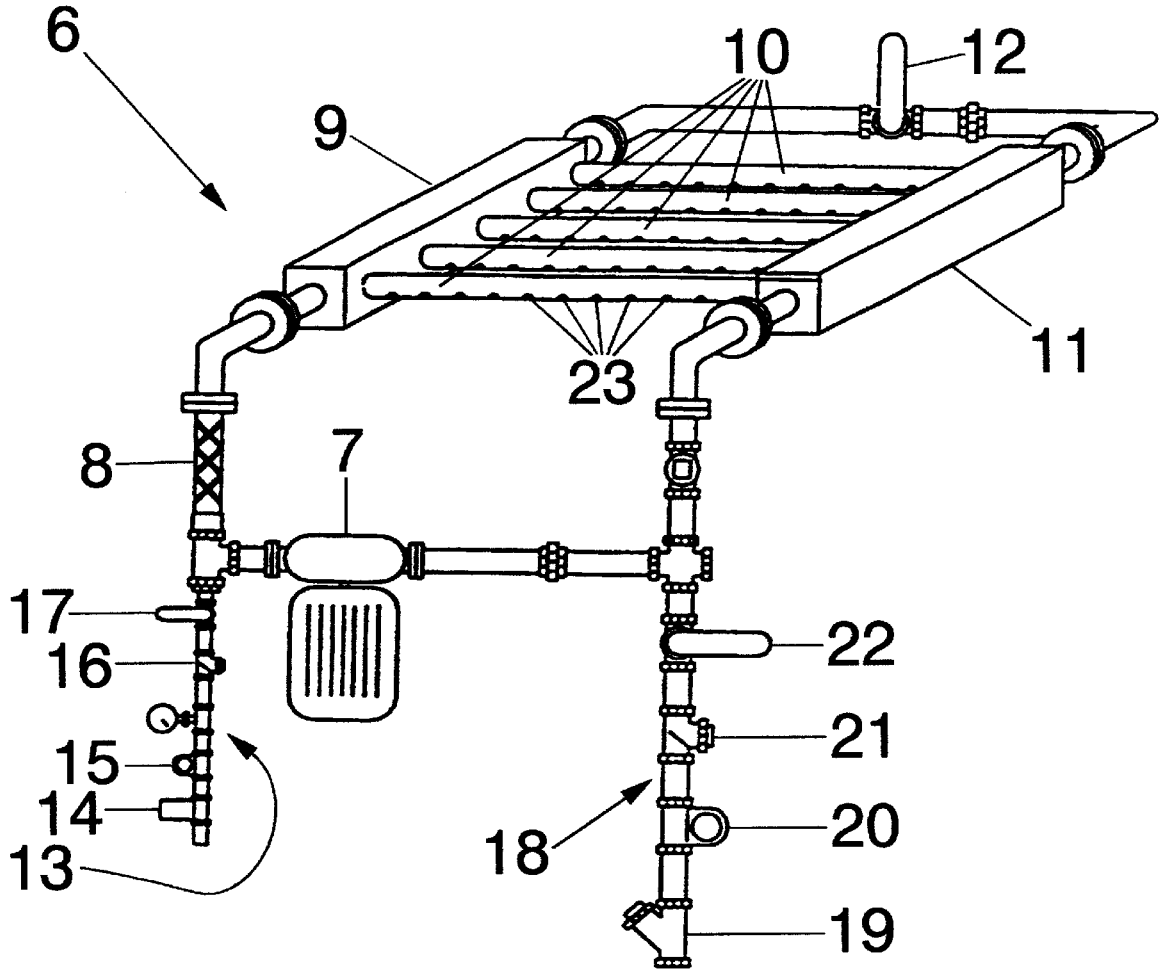
FIG. 2 is a perspective view of the air and water circulation system according to the invention.

Aeration is achieved using circulation system 6, as shown in FIG. 2. Circulation system 6 consists of pump 7 that circulates water through high-shear device 8 and subsequently through inlet header 9 followed by a series of distribution pipes 10 located in the base of upper separation chamber 2. Distribution pipes 10 terminate in return header 11 that is connected to the intake side of pump 7. By-pass circulation control valve 12, shown in FIG. 2, is used to regulate the flow through pipes 10.

Air feed system 13, shown in FIGS. 1 and 2, injects air into circulation system 6 between pump 7 discharge and shear device 8. Air feed system 13 consists of pressure regulator 14, air flow meter 15, check valve 16 and flow regulating valve 17. Water enters circulation system 6 through flow control manifold 18. Flow control manifold 18 consists of strainer 19, flow meter 20, check valve 21 and flow regulating valve 22. Water entering circulation system 6 discharges through perforations 23 in the base of pipes 10. Other aeration techniques could be employed to mix the air and water before introducing the fluid to the separator.

Figure 3:
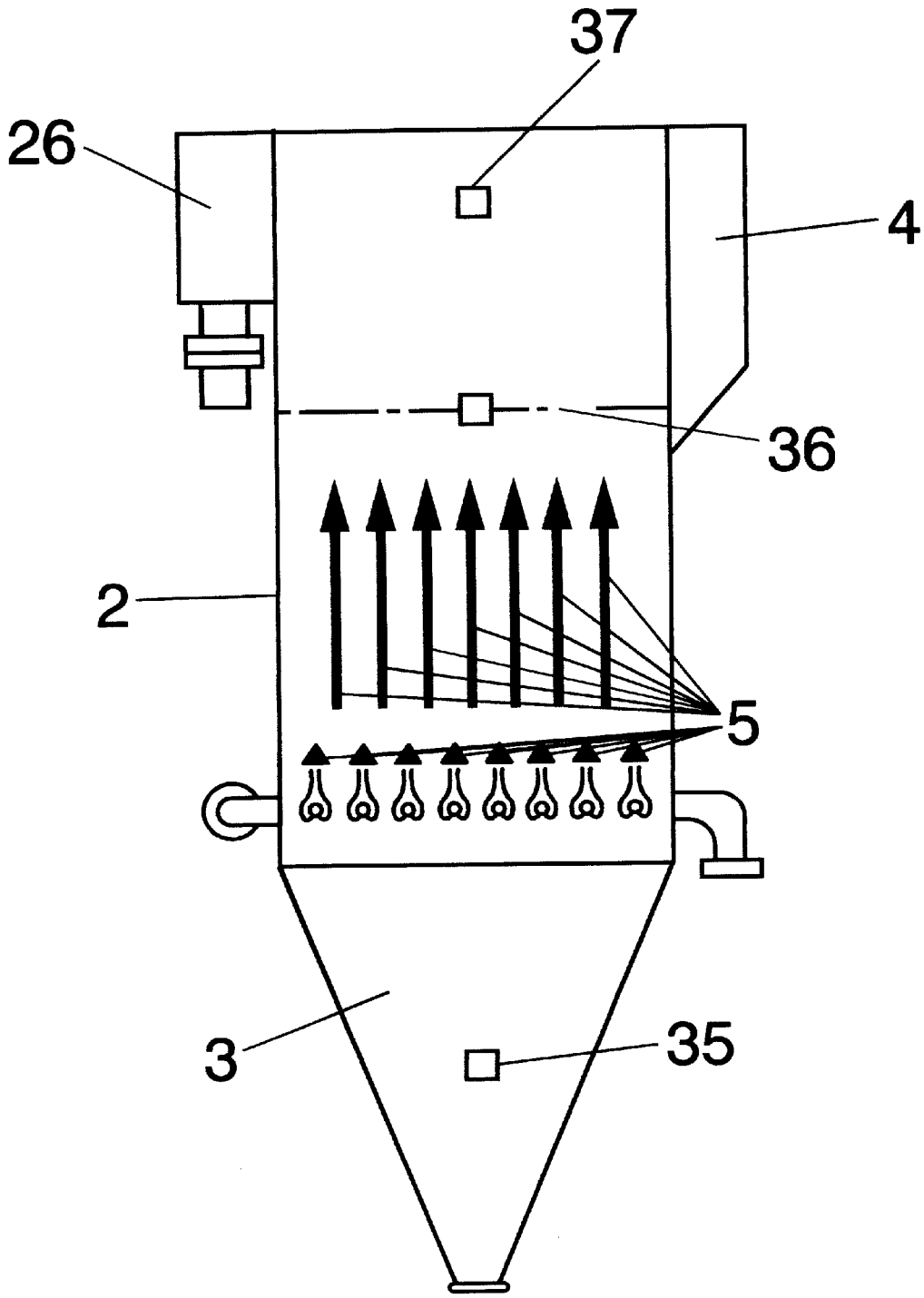
FIG. 3 is a side view of the main housing showing the upwardly rising flow of water in the upper separation chamber.

The method of the present invention consists of particles entering the separator through feed inlet 33 in feed inlet chamber 4 and establishing a fluidized bed created by the upward rise of water introduced in the base of upper separation chamber 2. This process is shown in greater detail in FIG. 3. High-density particles 24 migrate towards the base, as shown at 35, of the separator and form a hindered teeter-bed. Due to the effective, density, the teetering solids also act as a dense media bed. Particles having a density lower than the apparent density of the teeter bed do not initially enter the bed. Fine lower-density particles 25 that collect on the teeter-bed interface, as shown at 36, are carried to the top of the separator, as shown at 37, and report to collection launder 26. Coarse, low-density material 27 will continue to gather at the teeter-bed interface and eventually migrate downwards.

To compensate for the loss of coarse low-density material 27, the teeter-bed is aerated. Aeration is accomplished by passing the air/water mixture through high shear device 8 that produces finely dispersed bubbles. The dispersed bubbles are injected into the base of upper separation chamber 2 through pipes 10. Bubbles 28 produced by high-shear device 8 migrate through the teeter bed and selectively attach to the surface of low-density particles. Selectivity either occurs naturally (e.g., coal) or is chemically induced (e.g., silica). The bubble-particle aggregates, having an effective density that is further reduced, subsequently migrate back to the surface of the teeter bed. The bubble particle aggregates build a layer upward from the interface of the teetering high-density solids until they overflow into collection launder 26.

Higher-density particles migrate towards the bottom of upper separation chamber 2 and report to dewatering cone 3. The underflow product is discharged through control valve 29 that is actuated based on a signal provided by process controller 30. Process controller output is proportional to an input signal derived from pressure sensor 31 located on the side of upper separation chamber 2. It should be noted that the reference to low-density particles in the above discussion includes any particulate species that has been effectively modified through the attachment of air bubbles. Likewise, reference to high-density particles implies all particulates that have not been modified.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A method of separating at least one of a plurality of species of particulate solids from the remaining species, said method comprising the steps of:

providing an upward flow of water;

providing an upward flow of air bubbles;

providing a mixture of said plurality of species of particulate solids, said species of particulate solids having one or more specific gravities;

permitting a hindered fluidized bed to form;

attaching air bubbles selectively to one or more species present in said mixture of particulate solids effectively lowering an apparent specific gravity of said one or more species;

gathering said one or more species with the lowered apparent specific gravity in an upper portion of the hindered fluidized bed;

gathering the remaining species with a higher apparent specific gravity in a lower portion of the hindered, fluidized bed.

2. The method recited in claim 1 further comprising permitting air bubbles to selectively attach to one or more of the species.

3. The method recited in claim 1 further comprising providing hydrophobic particles for the air bubbles to attach to.

4. The method recited in claim 1 further comprising activating one or more species of particles chemically to promote attachment of air bubbles.

5. A method of separating a mixture of species of particulate solids by species, each species having a specific gravity, the method comprising the steps of:

(1) providing an upward flow of water;

(2) providing an upward flow of air bubbles;

(3) forming a hindered fluidized bed;

(4) attaching air bubbles selectively to one or more of said species to effectively lower an apparent specific gravity of said one or more species of particulate solids;

whereby steps (1) and (2) are performed concurrently.

6. The method of 5 further comprising the step of adding the species of particulate solids to be separated as needed.

7. The method of claim 5 further comprising the step of gathering species of particulate solids with lower effective specific gravities in an upper area.

8. The method of claim 7 further comprising the step of collecting the species of particulate solids with lower effective specific gravities in the upper area.

9. The method of claim 5 further comprising the step of gathering the species of particulate solids with higher specific gravities in a lower area.

10. The method of claim 9 further comprising the step of collecting the species of particulate solids with higher specific gravities in the lower area.

11. The method of claim 5 further comprising providing hydrophobic particles for the air bubbles to attach to.

12. The method of claim 5 further comprising activating one or more species of particulate solids chemically to promote attachment of air bubbles thereto.

13. A method of separating a mixture of particulate solids by species, each said species having its own specific gravity, the method comprising the steps of:

(1) forming a hindered fluidized bed;

(2) lowering an effective specific gravity of selected species of particulate solids by attaching air bubbles thereto;

(3) gathering the species with the lower effective specific gravity in an upper portion of the hindered fluidized bed;

(4) gathering the species with the higher effective specific gravity in a lower portion of the hindered fluidized bed;

whereby steps (3) and (4) are conducted concurrently.

14. The method of claim 13 further comprising the step of collecting the species of particulate solids with the lower effective specific gravity from the upper area.

15. The method of claim 13 further comprising the step of collecting the species of particulate solids with the higher effective specific gravity from the lower area.

16. The method of claim 13 further comprising the step of adding species of particulate solids to be separated as needed.

17. The method of claim 13 further comprising permitting the air bubbles to selectively attach to one or more of the species.

18. The method recited to claim 13 further comprising providing hydrophobic particles for the air bubbles to attach to.

19. The method recited in claim 13 further comprising activating one or more species of particles chemically to promote attachment of air bubbles.

20. A method of separating a mixture of species of particulate solids, each species having a specific gravity, the method comprising the steps of:

forming a hindered fluidized bed;

attaching air bubbles selectively to one or more of said species of particulate solids whereby the effective specific gravity of said one or more species is lowered.

* * * * *